US007360489B1

(12) United States Patent
Han et al.

(10) Patent No.: US 7,360,489 B1
(45) Date of Patent: Apr. 22, 2008

(54) NON-LETHAL CARGO PROJECTILE

(75) Inventors: Seungeuk Han, Fort Lee, NJ (US); Raymond Trohanowsky, Franklin, NJ (US); Andew Ponikowski, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 273 days.

(21) Appl. No.: 11/278,556

(22) Filed: Apr. 4, 2006

Related U.S. Application Data

(60) Provisional application No. 60/594,479, filed on Apr. 12, 2005.

(51) Int. Cl.
*F42B 12/36* (2006.01)

(52) U.S. Cl. ..... 102/445; 102/444; 102/498; 102/502; 102/504; 89/1.35

(58) Field of Classification Search ..... 102/444, 102/445, 498, 502, 504; 89/1.35
See application file for complete search history.

(56) References Cited

U.S. PATENT DOCUMENTS 3,633,507 A * 1/1972 Morley et al. ..... 102/387
3,791,300 A * 2/1974 Prochnow et al. ..... 102/339
4,972,776 A * 11/1990 Shumaker et al. ..... 102/402
5,661,257 A * 8/1997 Nielson et al. ..... 102/334
5,684,267 A * 11/1997 Dean ..... 102/489
5,973,994 A * 10/1999 Woodall ..... 367/4

* cited by examiner

*Primary Examiner*—Troy Chambers
(74) *Attorney, Agent, or Firm*—John F. Moran

(57) ABSTRACT

A non-lethal cargo projectile comprises a projectile body; a fuze adapter attached to a front of the projectile body; a fuze attached to the fuze adapter; a boattail attached to a rear of the projectile body; a pressure tube extending from the fuze adapter to the boattail; a decelerator and drogue chute disposed aft of the fuze adapter; a flexible line that connects the pressure tube to the decelerator; a center disc disposed aft of the decelerator and drogue chute; a rear disc disposed aft of the center disc, the center disc and the rear disc defining a payload volume therebetween; a second flexible line that connects the rear disc to the boattail; at least one shearable fastener that fastens the projectile body to the fuze adapter; and at least one vent extending from the boattail to the fuze adapter.

14 Claims, 4 Drawing Sheets

NON-LETHAL CARGO PROJECTILE

CROSS-REFERENCE TO RELATED APPLICATIONS

This application claims the benefit under 35 USC 119(e) of U.S. provisional patent application 60/594,479 filed on Apr. 12, 2005, which is incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to cargo projectiles that dispense a payload and descend to the ground at a predetermined velocity, which velocity is scaleable for various non-lethal cargo applications.

The specific problem solved by the invention is controlling the descent rate of a projectile that is used for delivering various non-lethal payloads. Non-lethal projectiles should be non-lethal in every aspect. However, conventional non-lethal applications deliver non-lethal payloads using regular projectile cargo shells that descend at high speed with a significant weight and a lethal kinetic energy. For crowd dispersion or riot control, it may be desirable to deliver from a remote distance a payload such as tear gas or malodorant pellets. While it is desired to disperse the crowd or control the riot, it is not desired to kill or seriously injure anyone.

A problem arises when delivering the payload with conventional munition shells, which impact the ground with a full impact velocity that is converted to lethal kinetic energy. Therefore, there is a need for projectile that deliver non-lethal payloads to be equipped with non-lethal capability. The present invention renders a cargo projectile shell non-lethal by reducing its descent rate with a decelerator.

U.S. Pat. No. 6,782,289 discloses a non-lethal cargo carrier with a fuze located in the boattail. The rear-mounted fuze requires ballast for dynamic flight stability. Without ballast, the center of gravity of the projectile is too far rearward. The projectile with rear-mounted fuze is unlike most Army projectiles and requires special operational and logistic training. The single parachute used as the primary decelerator does not provide as much reliability as dual parachutes. The present invention overcomes the issues associated with the prior non-lethal cargo projectile.

SUMMARY OF THE INVENTION

It is an object of the invention to provide a non-lethal cargo projectile with a fuze mounted in the front of the projectile.

It is another object of the invention to provide a non-lethal cargo projectile wherein the contents of the projectile are ejected through the front of the projectile.

Still another object of the invention is to provide a non-lethal projectile that minimizes the ejection force on the contents of the projectile.

Yet another object of the invention is to provide a non-lethal projectile with a decelerator that is more reliable than a single parachute.

One aspect of the invention is a non-lethal cargo projectile comprising a projectile body;

a fuze adapter attached to a front of the projectile body; a fuze attached to the fuze adapter; a boattail attached to a rear of the projectile body; a pressure tube extending from the fuze adapter to the boattail; a decelerator and drogue chute disposed aft of the fuze adapter; a flexible line that connects the pressure tube to the decelerator; a center disc disposed aft of the decelerator and drogue chute; a rear disc disposed aft of the center disc, the center disc and the rear disc defining a payload volume therebetween; a second flexible line that connects the rear disc to the boattail; at least one shearable fastener that fastens the projectile body to the fuze adapter; and at least one vent extending from the boattail to the fuze adapter.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not to scale, like or corresponding parts are denoted by like or corresponding reference numerals.

DETAILED DESCRIPTION OF THE PREFERRED EMBODIMENTS

The invention uses a decelerator in the form of a dual parachute system to maximize the payload volume and bring the body components to the ground at a predetermined terminal velocity while improving reliability and safety. Other properly size decelerators may be used. Unlike a conventional projectile, all components and payloads are ejected through the front of the projectile. The tethering connections between the decelerator and the projectile can be of any type properly selected to withstand the loads of the overall system.

The deployment sequence starts with launch, then flight, then fuze detonation in air at a preset time at a predetermined height and location. Then, the payload is ejected and the projectile body descends to the ground. The decelerator is attached to the projectile and will bring the body to the ground at a predetermined descent rate. The descent rate is determined by the size and type of decelerator and can be tailored for any application requirement.

Figure 1:
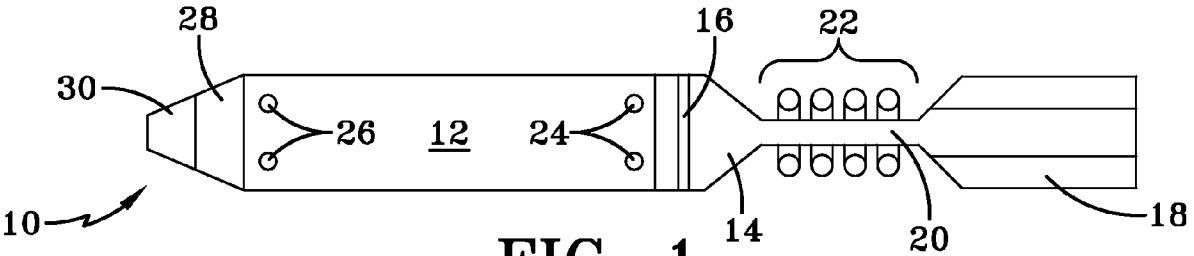
FIG. 1 is a side view of one embodiment of a non-lethal projectile.

FIG. 1 is a side view of one embodiment of a non-lethal projectile 10. Projectile 10 includes a body 12, a fuze adapter 28 attached to the front of the body 12, a fuze 30 attached to the fuze adapter 28, at least one shear pin 26 that fastens the body 12 to the fuze adapter 28, a boattail 14 including a boom 20 and fins 18, propellant 22 disposed around the boom 20, connection pins 24 that fasten the body 12 to the boattail 14 and an obturator 16. Connection pins 24 are one way to fasten the body 12 to the boattail 14, but other means may be used, such as threads, weldments, etc. Likewise, shear pins 26 are one way to fasten the body 12 to the fuze adapter 28. However, any shearable fastener may be used, such as low strength glue, a crimped joint, or a low strength weld. When fuze 30 is detonated, it produces hot gases.

Figure 2:
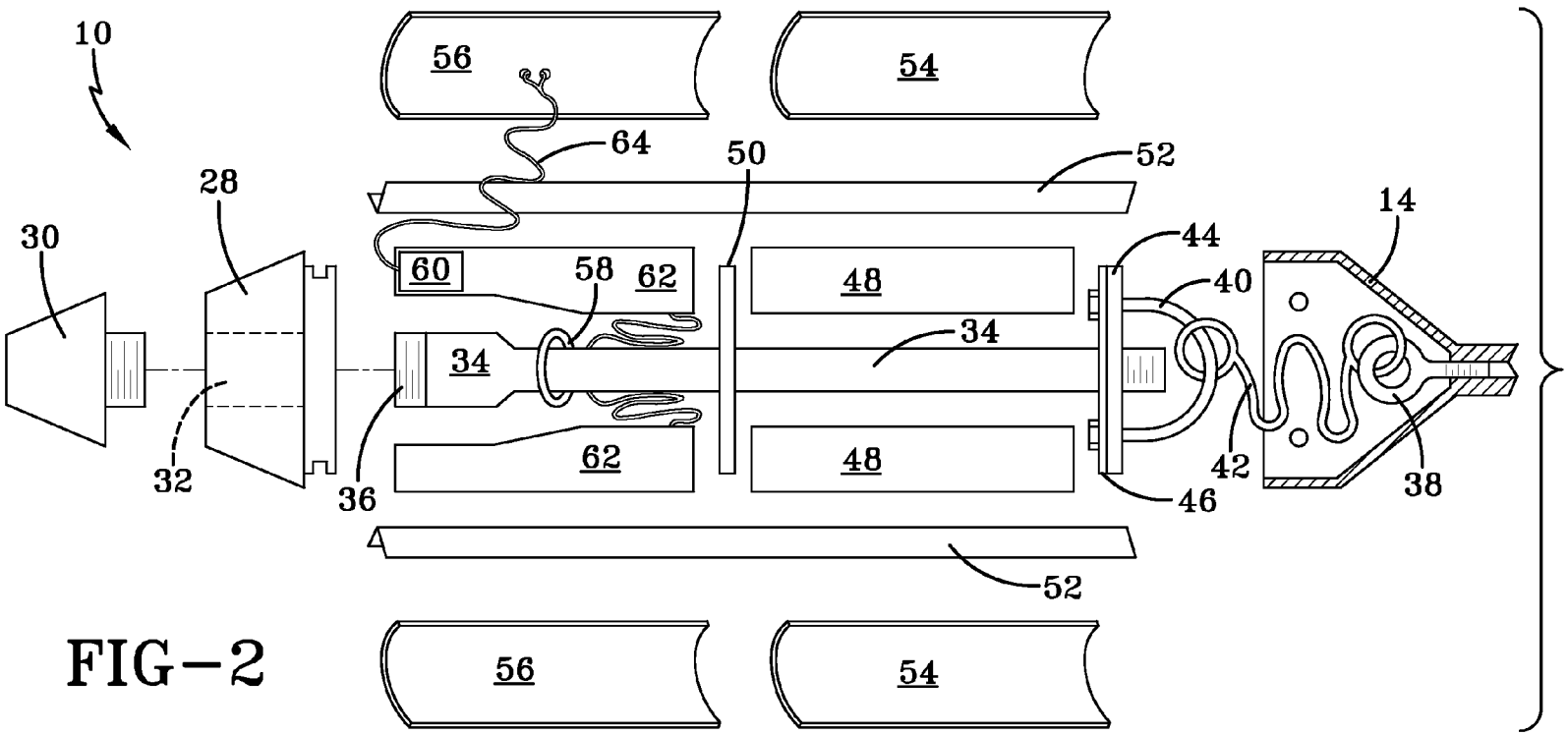
FIG. 2 is an exploded view of the projectile of FIG. 1.

FIG. 2 is an exploded view of the projectile 10 of FIG. 1. The body 12 is not shown in FIG. 2. Projectile 10 further includes a pressure tube 34 extending from the fuze adapter 28 to the boattail 14. The pressure tube 34 is a conduit for hot gases that are produced in the fuze 30 and delivered to the boattail 14. Fuze 30 and pressure tube end 36 may be threaded into well 32 of fuze adapter 28. A decelerator is disposed aft of the fuze adapter 28. In the embodiment shown, the decelerator comprises a drogue chute 60, two main chutes 62 and two bags 76 (FIG. 6) that encase the main chutes 62. A flexible line or tether 58 (made of, for example, KEVLAR) attaches the pressure tube 34 to the main chutes 62. Preferably, the tether 58 is attached to the pressure tube 34 with a loop or swivel.

A first pair of side plates 56 are disposed around the decelerator. A center disc 50 is disposed aft of the first pair of side plates 56 and includes a through hole for the pressure tube 34. A second pair of side plates 54 are disposed aft of the center disc 50. Side plates 56, 54 are very lightweight and may be made of, for example, cardboard. A rear disc 44 is disposed aft of the second pair of side plates 54. The center disc 50 and the rear disc 44 define a payload volume therebetween for a non-lethal payload 48. A flexible line or tether 42 (made of, for example, KEVLAR) connects a U-bolt 40 attached to the rear disc 44 to an eye-bolt 38 in the boattail 14. The U-bolt 40 and eye-bolt 38 are examples of fasteners. Other types of fasteners may be used. A least one vent 52 extends from the boattail 14 to the fuze adapter 28. Vents 52 are made of a lightweight material such as aluminum. A vent support disc 46 is attached to the rear disc 44.

Figure 3B:
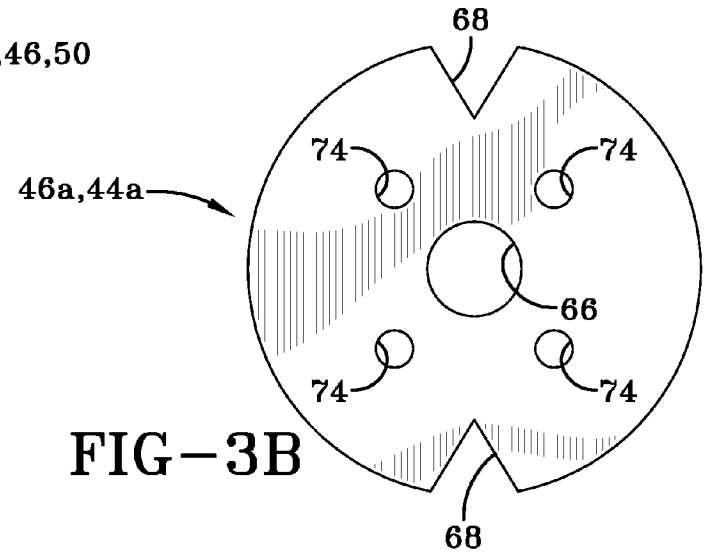
FIGS. 3A and 3B show embodiments of discs used with the projectile.
Figure 3A:
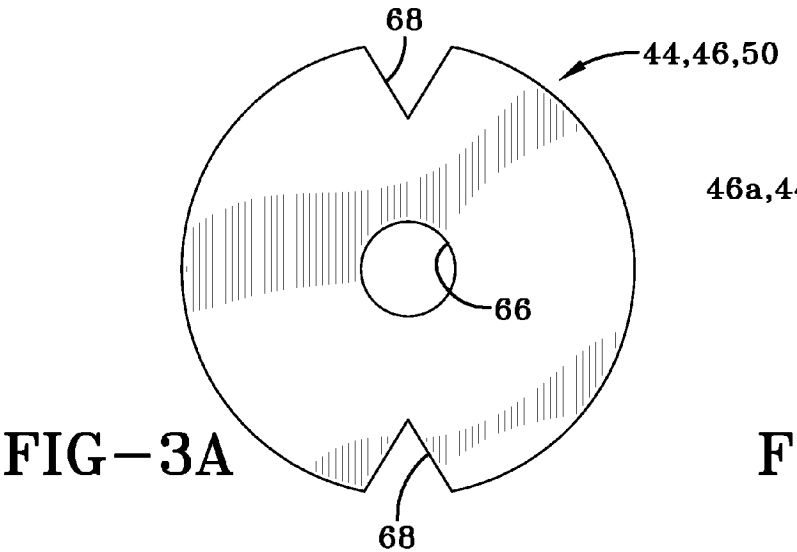

In the embodiment shown, vents 52 are triangular in shape, but other configurations may be used. FIG. 3A shows a front view of rear disc 44, vent support disc 46 and center disc 50. Each disc includes an opening 66 for pressure tube 34 and V-shaped grooves 68 for vents 52. In the case of the center disc 50, the pressure tube 34 may slide with respect to the disc 50. For rear disc 44, however, the pressure tube 34 is attached to the disc 44 by, for example, threads, welding, etc. Vents 52 lie in the grooves 68 in center disc 50 and vent support disc 46. The front ends of vents 52 abut the rear face of the fuze adapter 28. Rear ends of the vents 52 abut the front face of the rear disc 44. The grooves 68 in the rear disc 44 provide an opening for hot gases to enter vents 52 from boattail 14.

In some applications, for example, smoke generators or illuminators, the non-lethal payload 48 needs to be ignited. FIG. 3B shows an embodiment of the rear and vent support discs 44*a*, 46*a* that includes a plurality of openings 74. The openings 74 allow for ignition of the payload 48 by the hot gases in the boattail 14.

Figure 4:
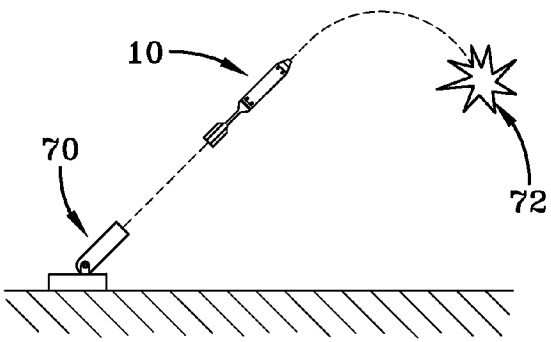
FIG. 4 shows the launch of the projectile.

FIG. 4 shows the launch of projectile 10 from a launcher 70. The projectile 10 is launched over the target area. At a preset time, the fuze 30 of the projectile 10 detonates to produce hot gases, as shown at 72. At fuze detonation, hot gases travel down the pressure tube 34. The hot gases pressurize the boattail 14. The boattail pressure is applied against the rear disc 44. The pressure on the rear disc 44 creates a forward force on the pressure tube 34 that is transferred to the fuze adapter 28. Simultaneously, the vents 52 are pressurized by gas leaving boattail 14 through grooves 68 in rear disc 44.

Figure 5:
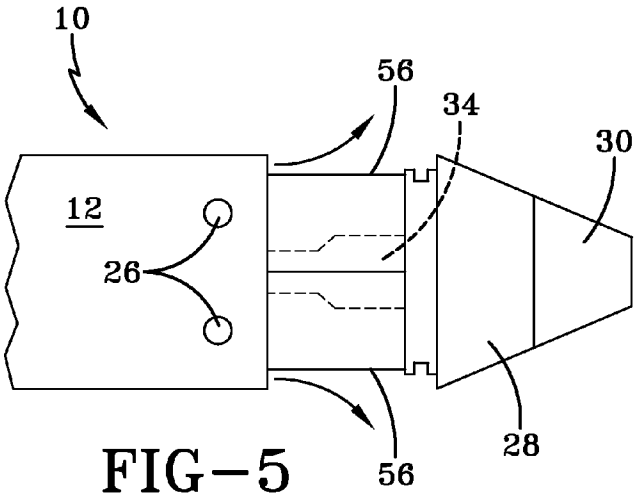
FIG. 5 is a partial view of the projectile showing initial separation.

The fuze adapter 28 shears the shearable fasteners (for example, shear pins 26) that connect the fuze adapter 28 and the body 12. When the shearable fasteners are sheared, the fuze adapter 28 begins to move forward. As soon as the fuze adapter 28 moves forward, the vents 52 release the pressure out of the boattail 14, as shown by the thick arrows in FIG. 5. Immediate release of the pressure is important to reduce the force generated on the fuze and pressure tube assembly. Reducing the force on the fuze and pressure tube assembly helps to minimize the force eventually exerted on the tether 42. By using this venting technique to control the force, a lower strength tether may be used.

Figure 6:
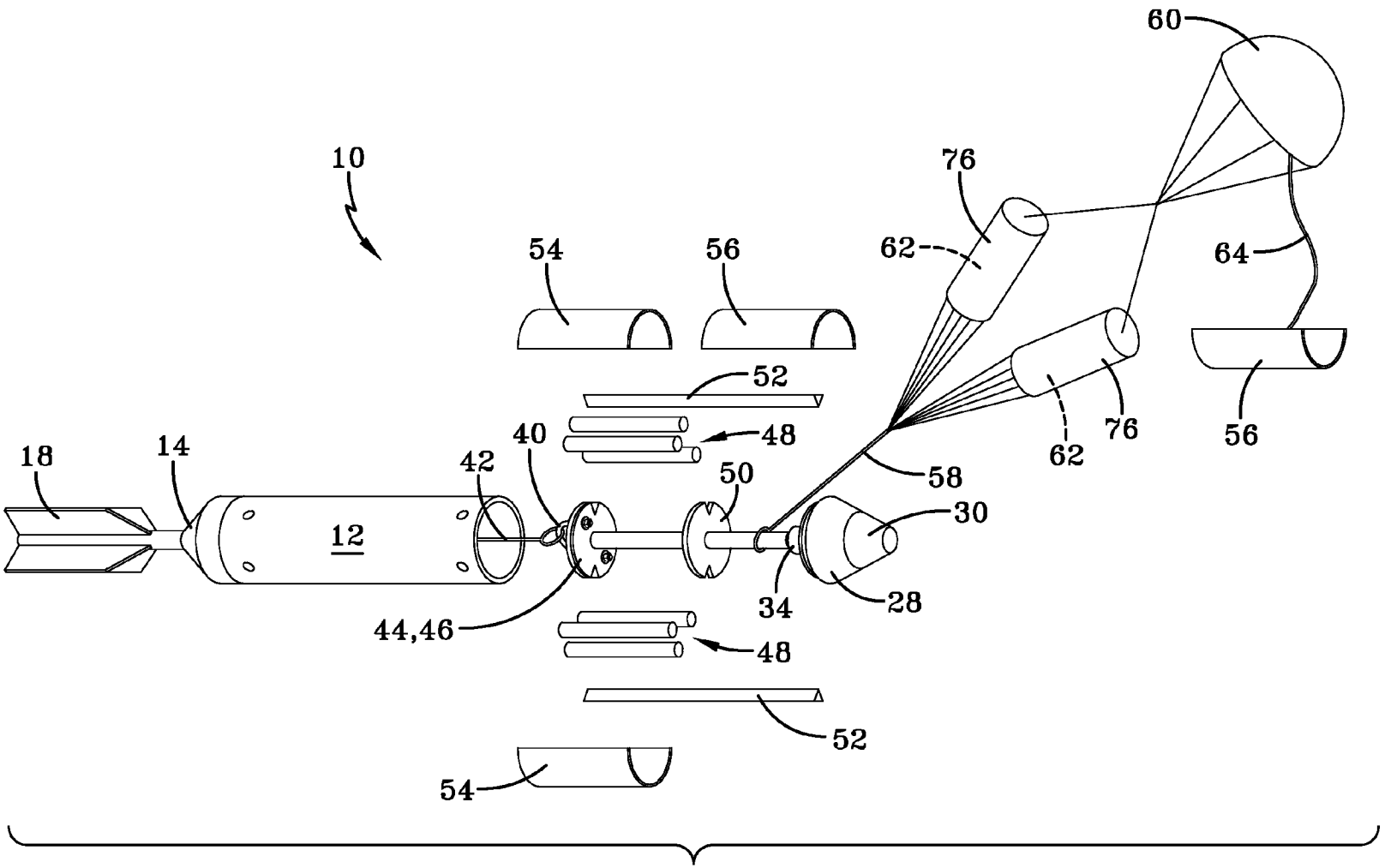
FIG. 6 shows the projectile as the main decelerator begins to deploy.
Figure 7:
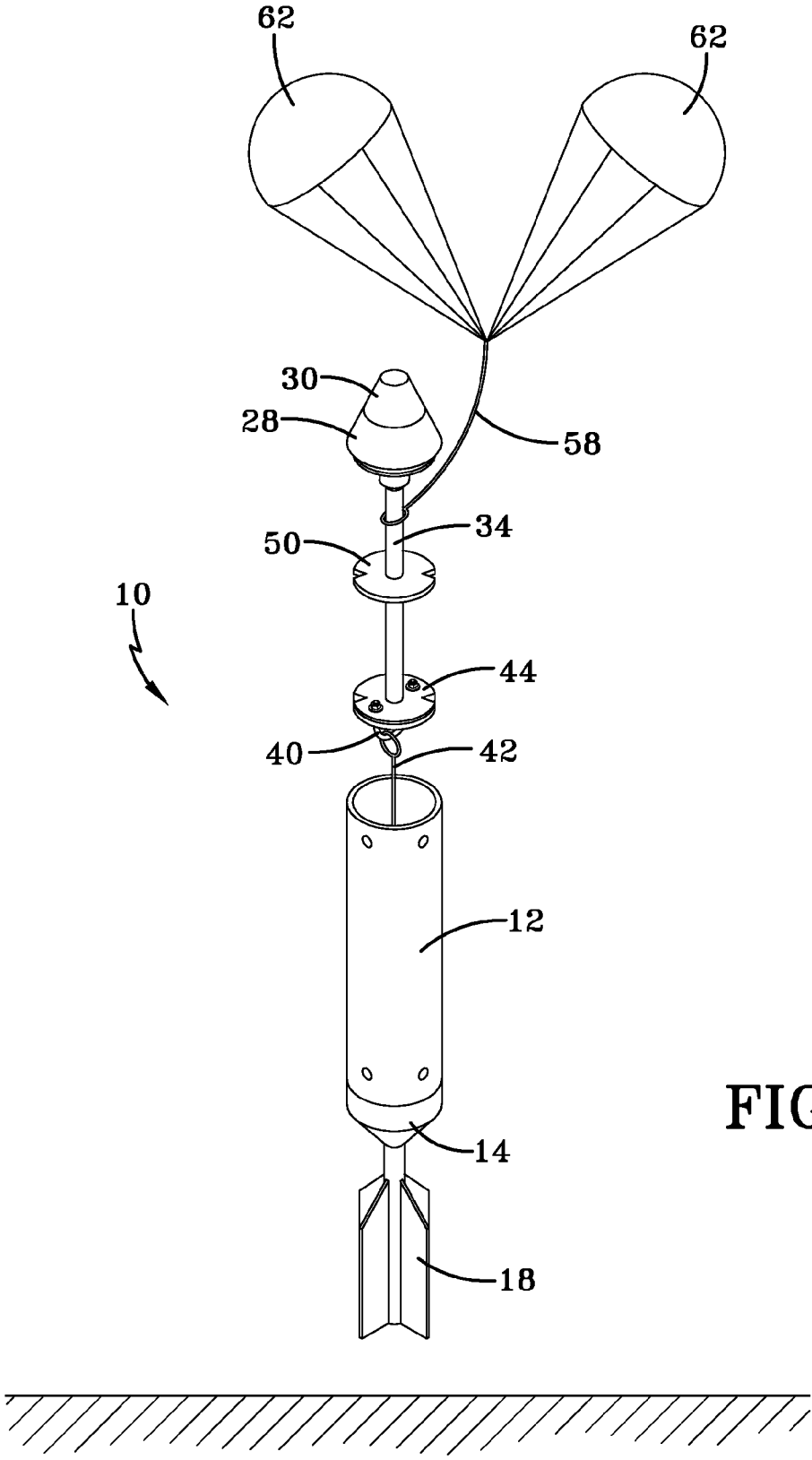
FIG. 7 shows the projectile in descent.

FIG. 6 shows the projectile 10 as the main decelerator begins to deploy. As the fuze 30 and pressure tube 34 are pushed out of the body 12, the air stream catches the side panel 56 that is attached to drogue chute 60 with flexible line 64. The side panel 56 pulls the drogue chute 60 away from the body 12. The air stream catches the drogue chute 60. The drogue chute 60 stretches the main tether 58 and pulls the bags 76 off the main chutes 62. The main chutes 62 deploy. As this sequence of events occurs, the payload 48 is ignited (if required) and deployed over the target. The side panels 54, 56 and vents 52 are expelled from the body 12. As the main chutes 62 inflate, the body 12 and fuze/pressure tube assembly descend below the main chutes 62. The projectile 10 impacts the ground at its terminal velocity, which is determined by the sizing of the main chutes 62. FIG. 7 shows the projectile 10 in descent.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A non-lethal cargo projectile, comprising:

a projectile body;

a fuze adapter attached to a front of the projectile body;

a fuze attached to the fuze adapter;

a boattail attached to a rear of the projectile body;

a pressure tube extending from the fuze adapter to the boattail;

a decelerator and drogue chute disposed aft of the fuze adapter;

a flexible line that connects the pressure tube to the decelerator;

a center disc disposed aft of the decelerator and drogue chute;

a rear disc disposed aft of the center disc, the center disc and the rear disc defining a payload volume therebetween;

a second flexible line that connects the rear disc to the boattail;

at least one shearable fastener that fastens the projectile body to the fuze adapter; and at least one vent extending from the boattail to the fuze adapter.

2. The projectile of claim 1 further comprising a first pair of side plates disposed around the decelerator and a second pair of side plates disposed around the payload volume.

3. The projectile of claim 2 wherein the drogue chute includes a canopy end connected to one of the first pair of side plates and a payload end connected to the decelerator.

4. The projectile of claim 3 further comprising a non-lethal payload disposed in the payload volume.

5. The projectile of claim 3 wherein the decelerator comprises a pair of parachutes disposed in bags, the bags being connected to the payload end of the drogue chute.

6. The projectile of claim 3 further comprising a vent support disc attached to the rear disc.

7. The projectile of claim 1 wherein the at least one vent has a triangular cross-section.

8. The projectile of claim 1 wherein the rear disc includes at least one opening therein that connects the boattail to the payload volume.

9. The projectile of claim 6 wherein the center disc and vent support disc include grooves formed therein for supporting the at least one vent and the rear disc includes a groove formed therein for venting gas from the boattail to the at least one vent.

10. The projectile of claim 2 wherein the first and second pair of side plates comprise cardboard.

11. The projectile of claim 1 wherein the pressure tube is fixed to the rear disc.

12. The projectile of claim 10 wherein the at least one vent comprises aluminum.

13. The projectile of claim 1 wherein the first and second flexible lines comprise KEVLAR.

14. The projectile of claim 1 wherein the shearable fastener comprises one or more of a shear pin, a crimped joint, low strength glue and a low strength weld.

* * * * *